US008857541B2

(12) United States Patent
Mourik et al.

(10) Patent No.: US 8,857,541 B2
(45) Date of Patent: Oct. 14, 2014

(54) DIAMOND TRANSITION LAYER CONSTRUCTION WITH IMPROVED THICKNESS RATIO

(75) Inventors: Nephi M. Mourik, Provo, UT (US); Peter T. Cariveau, Draper, UT (US); Michael Stewart, Provo, UT (US); Frederico Bellin, The Woodlands, TX (US); Yi Fang, Provo, UT (US)

(73) Assignee: Smith International, Inc., Houston, TX (US)

( * ) Notice: Subject to any disclaimer, the term of this patent is extended or adjusted under 35 U.S.C. 154(b) by 332 days.

(21) Appl. No.: 12/851,753

(22) Filed: Aug. 6, 2010

(65) Prior Publication Data

US 2011/0031032 A1 Feb. 10, 2011

Related U.S. Application Data

(60) Provisional application No. 61/232,122, filed on Aug. 7, 2009.

(51) Int. Cl.

| | |
|---|---|
| ***E21B 10/36*** | (2006.01) |
| ***C22C 26/00*** | (2006.01) |
| ***E21B 10/567*** | (2006.01) |

(52) U.S. Cl.

CPC ..... *E21B 10/5673* (2013.01); *C22C 26/00* (2013.01); *B22F 2999/00* (2013.01); *C22C 2204/00* (2013.01)

USPC ..... 175/434; 175/420.2; 175/428

(58) Field of Classification Search

USPC ..... 175/405.1, 420.2, 428, 434

See application file for complete search history.

(56) References Cited

U.S. PATENT DOCUMENTS

| | | | |
|---|---|---|---|
| 2,941,241 | A | 6/1960 | Strong |
| 2,941,248 | A | 6/1960 | Hall |
| 2,947,611 | A | 8/1960 | Bundy |
| 3,609,818 | A | 10/1971 | Wentorf, Jr. |
| 3,767,371 | A | 10/1973 | Wentorf, Jr. |

(Continued)

FOREIGN PATENT DOCUMENTS

| | | |
|---|---|---|
| EP | 0219959 | 4/1987 |
| EP | 0235455 A2 | 9/1987 |

(Continued)

OTHER PUBLICATIONS

International Search Report and Written Opinion dated Mar. 23, 2011 for related PCT application No. PCT/US2010/044640 filed Aug. 6, 2010.

(Continued)

*Primary Examiner* — Cathleen Hutchins

(57) ABSTRACT

An insert for a drill bit may include a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least two transition layers between the metallic carbide body and the outer layer, the at least two transition layers comprising: an outermost transition layer comprising a composite of second diamond grains, first metal carbide or carbonitride particles, and a second binder material; and an innermost transition layer comprising a composite of third diamond grains, second metal carbide or carbonitride particles, and a third binder material wherein a thickness of the outer layer is lesser than that of each of the at least two transition layers.

12 Claims, 5 Drawing Sheets

(56) References Cited

U.S. PATENT DOCUMENTS

| | | | | |
|---|---|---|---|---|
| 4,224,380 | A | 9/1980 | Bovenkerk et al. | |
| 4,289,503 | A | 9/1981 | Corrigan | |
| 4,311,490 | A | 1/1982 | Bovenkerk et al. | |
| 4,604,106 | A | 8/1986 | Hall | |
| 4,667,756 | A | 5/1987 | King et al. | |
| 4,673,414 | A | 6/1987 | Lavens | |
| 4,694,918 | A | 9/1987 | Hall | |
| 4,813,500 | A | 3/1989 | Jones | |
| 4,954,139 | A | 9/1990 | Cerutti | |
| RE33,757 | E | 12/1991 | Weaver | |
| 5,290,507 | A | 3/1994 | Runkle | |
| 5,370,195 | A | 12/1994 | Keshavan | |
| 5,732,783 | A | 3/1998 | Truax et al. | |
| 6,009,962 | A | 1/2000 | Beaton | |
| 6,095,265 | A | 8/2000 | Alsup | |
| 6,193,000 | B1 | 2/2001 | Caraway et al. | |
| 6,199,645 | B1 | 3/2001 | Anderson | |
| 6,241,036 | B1 | 6/2001 | Lovato et al. | |
| 6,290,008 | B1 * | 9/2001 | Portwood et al. | 175/426 |
| 6,296,069 | B1 | 10/2001 | Lamine et al. | |
| 6,371,226 | B1 | 4/2002 | Caraway | |
| 6,375,706 | B2 | 4/2002 | Kembaiyan et al. | |
| 6,443,248 | B2 * | 9/2002 | Yong et al. | 175/428 |
| 6,458,471 | B2 | 10/2002 | Lovato et al. | |
| 6,461,401 | B1 | 10/2002 | Kembaiyan et al. | |
| 6,474,425 | B1 | 11/2002 | Truax et al. | |
| 6,510,906 | B1 | 1/2003 | Richert et al. | |
| 6,651,757 | B2 | 11/2003 | Belnap et al. | |
| 6,725,953 | B2 | 4/2004 | Truax et al. | |
| 6,742,611 | B1 | 6/2004 | Illerhaus et al. | |
| 6,843,333 | B2 | 1/2005 | Richert et al. | |
| 6,951,578 | B1 | 10/2005 | Belnap et al. | |
| 7,234,550 | B2 | 6/2007 | Azar et al. | |
| 7,350,599 | B2 | 4/2008 | Lockwood et al. | |
| 7,350,601 | B2 | 4/2008 | Belnap | |
| 7,377,341 | B2 | 5/2008 | Middlemiss et al. | |
| 7,426,969 | B2 | 9/2008 | Azar | |
| 7,469,757 | B2 | 12/2008 | Azar et al. | |
| 7,497,280 | B2 | 3/2009 | Brackin et al. | |
| 7,533,740 | B2 | 5/2009 | Zhang et al. | |
| 7,757,793 | B2 | 7/2010 | Voronin et al. | |
| 2001/0000101 | A1 | 4/2001 | Lovato et al. | |
| 2001/0002557 | A1 | 6/2001 | Kembaiyan et al. | |
| 2001/0008190 | A1 | 7/2001 | Scott | |
| 2001/0047891 | A1 | 12/2001 | Truax | |
| 2002/0007972 | A1 * | 1/2002 | Yong et al. | 175/374 |
| 2002/0125048 | A1 | 9/2002 | Traux et al. | |
| 2003/0111273 | A1 | 6/2003 | Richert et al. | |
| 2004/0037948 | A1 | 2/2004 | Tank | |
| 2004/0154840 | A1 | 8/2004 | Azar et al. | |
| 2004/0245022 | A1 | 12/2004 | Izaguirre et al. | |
| 2005/0133276 | A1 | 6/2005 | Azar | |
| 2005/0133278 | A1 | 6/2005 | Azar | |
| 2005/0230150 | A1 | 10/2005 | Oldham et al. | |
| 2006/0032677 | A1 | 2/2006 | Azar et al. | |
| 2006/0166615 | A1 * | 7/2006 | Tank et al. | 451/540 |
| 2006/0283637 | A1 | 12/2006 | Viel et al. | |
| 2007/0215389 | A1 | 9/2007 | Da Silva et al. | |
| 2007/0215390 | A1 | 9/2007 | Azar et al. | |
| 2007/0284153 | A1 | 12/2007 | Richert et al. | |
| 2008/0017421 | A1 | 1/2008 | Lockwood | |
| 2008/0073126 | A1 | 3/2008 | Shen | |
| 2008/0128951 | A1 | 6/2008 | Lockwood et al. | |
| 2008/0135306 | A1 | 6/2008 | Da Silva et al. | |
| 2008/0142262 | A1 | 6/2008 | Drivdahl et al. | |
| 2008/0149398 | A1 | 6/2008 | Azar | |
| 2008/0185189 | A1 | 8/2008 | Griffo et al. | |
| 2008/0202821 | A1 | 8/2008 | McClain et al. | |
| 2008/0223623 | A1 | 9/2008 | Keshavan et al. | |
| 2008/0230280 | A1 | 9/2008 | Keshavan et al. | |
| 2008/0282618 | A1 | 11/2008 | Lockwood | |
| 2009/0090563 | A1 * | 4/2009 | Voronin et al. | 175/434 |
| 2009/0095532 | A1 | 4/2009 | Laird et al. | |
| 2009/0107732 | A1 | 4/2009 | McClain et al. | |
| 2009/0120008 | A1 | 5/2009 | Lockwood | |
| 2009/0133938 | A1 | 5/2009 | Hall | |
| 2009/0173547 | A1 | 7/2009 | Voronin et al. | |
| 2009/0273224 | A1 | 11/2009 | Hall | |
| 2010/0062253 | A1 | 3/2010 | Egan et al. | |
| 2010/0196717 | A1 | 8/2010 | Liversage et al. | |
| 2010/0236836 | A1 | 9/2010 | Voronin | |
| 2011/0031033 | A1 | 2/2011 | Mourik | |
| 2011/0031037 | A1 | 2/2011 | Bellin | |
| 2011/0036643 | A1 | 2/2011 | Belnap | |
| 2011/0042147 | A1 | 2/2011 | Fang | |

FOREIGN PATENT DOCUMENTS

| | | | |
|---|---|---|---|
| EP | 0487355 | B1 | 3/1995 |
| EP | 1006257 | B1 | 2/2004 |
| EP | 1330323 | B1 | 5/2006 |
| WO | 200234437 | | 5/2002 |
| WO | 2008076908 | | 6/2008 |
| WO | 2008076908 | A2 | 6/2008 |
| WO | 2010020962 | | 2/2010 |

OTHER PUBLICATIONS

International Search Report and Written Opinion dated Mar. 30, 2011 for corresponding PCT application No. PCT/US2010/044664 filed Aug. 6, 2010.

International Search Report and Written Opinion dated Mar. 21, 2011 for related PCT application No. PCT/US2010/044698 filed Aug. 6, 2010.

International Search Report and Written Opinion dated Mar. 17, 2011 for related PCT application No. PCT/US2010/044657 filed Aug. 6, 2010.

"PCD Hammer Bit Inserts", Guilin Coller Engineered Diamond Technology (EDT) Co., Ltd., www.heavendiamonds.com.

International Search Report and Written Opinion of PCT Application No. PCT/US2010/044657 dated Mar. 17, 2011, pp. 1-8.

International Search Report and Written Opinion of PCT Application No. PCT/US2010/044698 dated Mar. 21, 2011, pp. 1-9.

International Search Report and Written Opinion of PCT Application No. PCT/US2010/044640 dated Mar. 23, 2011, pp. 1-8.

International Search Report and Written Opinion of PCT Application No. PCT/US2010/044664 dated Mar. 30, 2011, pp. 1-8.

Third Party Reference Submission of Australian Application No. 2010279358 dated Apr. 24, 2013, pp. 1-13.

Third Party Reference Submission of Australian Application No. 2010279280 dated Apr. 24, 2013, pp. 1-9.

Third Party Reference Submission of Australian Application No. 2010279295 dated Apr. 24, 2013, pp. 1-12.

* cited by examiner

DIAMOND TRANSITION LAYER CONSTRUCTION WITH IMPROVED THICKNESS RATIO

CROSS-REFERENCE TO RELATED APPLICATIONS

This application claims priority to U.S. Patent Application No. 61/232,122, filed on Aug. 7, 2009, the contents of which are herein incorporated by reference in their entirety.

BACKGROUND OF INVENTION

1. Field of the Invention

Embodiments disclosed herein relate generally to polycrystalline diamond enhanced inserts for use in drill bits, such as roller cone bits and hammer bits, in particular. More specifically, the invention relates to polycrystalline diamond enhanced inserts having an outer layer and at least one transition layer.

2. Background Art

In a typical drilling operation, a drill bit is rotated while being advanced into a soil or rock formation. The formation is cut by cutting elements on the drill bit, and the cuttings are flushed from the borehole by the circulation of drilling fluid that is pumped down through the drill string and flows back toward the top of the borehole in the annulus between the drill string and the borehole wall. The drilling fluid is delivered to the drill bit through a passage in the drill stem and is ejected outwardly through nozzles in the cutting face of the drill bit. The ejected drilling fluid is directed outwardly through the nozzles at high speed to aid in cutting, flush the cuttings and cool the cutter elements.

There are several types of drill bits, including roller cone bits, hammer bits, and drag bits. Roller cone rock bits include a bit body adapted to be coupled to a rotatable drill string and include at least one "cone" that is rotatably mounted to a cantilevered shaft or journal as frequently referred to in the art. Each roller cone in turn supports a plurality of cutting elements that cut and/or crush the wall or floor of the borehole and thus advance the bit. The cutting elements, either inserts or milled teeth, contact with the formation during drilling. Hammer bits are typically include a one piece body with having crown. The crown includes inserts pressed therein for being cyclically "hammered" and rotated against the earth formation being drilled.

Depending on the type and location of the inserts on the bit, the inserts perform different cutting functions, and as a result also, also experience different loading conditions during use. Two kinds of wear-resistant inserts have been developed for use as inserts on roller cone and hammer bits: tungsten carbide inserts and polycrystalline diamond enhanced inserts. Tungsten carbide inserts are formed of cemented tungsten carbide: tungsten carbide particles dispersed in a cobalt binder matrix. A polycrystalline diamond enhanced insert typically includes a cemented tungsten carbide body as a substrate and a layer of polycrystalline diamond ("PCD") directly bonded to the tungsten carbide substrate on the top portion of the insert. An outer layer formed of a PCD material can provide improved wear resistance, as compared to the softer, tougher tungsten carbide inserts.

The layer(s) of PCD conventionally include diamond and a metal in an amount of up to about 20 percent by weight of the layer to facilitate diamond intercrystalline bonding and bonding of the layers to each other and to the underlying substrate. Metals employed in PCD are often selected from cobalt, iron, or nickel and/or mixtures or alloys thereof and can include metals such as manganese, tantalum, chromium and/or mixtures or alloys thereof. However, while higher metal catalyst content typically increases the toughness of the resulting PCD material, higher metal content also decreases the PCD material hardness, thus limiting the flexibility of being able to provide PCD coatings having desired levels of both hardness and toughness. Additionally, when variables are selected to increase the hardness of the PCD material, typically brittleness also increases, thereby reducing the toughness of the PCD material.

Although the polycrystalline diamond layer is extremely hard and wear resistant, a polycrystalline diamond enhanced insert may still fail during normal operation. Failure typically takes one of three common forms, namely wear, fatigue, and impact cracking. The wear mechanism occurs due to the relative sliding of the PCD relative to the earth formation, and its prominence as a failure mode is related to the abrasiveness of the formation, as well as other factors such as formation hardness or strength, and the amount of relative sliding involved during contact with the formation. Excessively high contact stresses and high temperatures, along with a very hostile downhole environment, also tend to cause severe wear to the diamond layer. The fatigue mechanism involves the progressive propagation of a surface crack, initiated on the PCD layer, into the material below the PCD layer until the crack length is sufficient for spalling or chipping. Lastly, the impact mechanism involves the sudden propagation of a surface crack or internal flaw initiated on the PCD layer, into the material below the PCD layer until the crack length is sufficient for spalling, chipping, or catastrophic failure of the enhanced insert.

External loads due to contact tend to cause failures such as fracture, spalling, and chipping of the diamond layer. Internal stresses, for example thermal residual stresses resulting from the manufacturing process, tend to cause delamination between the diamond layer and the substrate or the transition layer, either by cracks initiating along the interface and propagating outward, or by cracks initiating in the diamond layer surface and propagating catastrophically along the interface.

The impact, wear, and fatigue life of the diamond layer may be increased by increasing the diamond thickness and thus diamond volume. However, the increase in diamond volume result in an increase in the magnitude of residual stresses formed on the diamond/substrate interface that foster delamination. This increase in the magnitude in residual stresses is believed to be caused by the difference in the thermal contractions of the diamond and the carbide substrate during cool-down after the sintering process. During cool-down after the diamond bodies to the substrate, the diamond contracts a smaller amount than the carbide substrate, resulting in residual stresses on the diamond/substrate interface. The residual stresses are proportional to the volume of diamond in relation to the volume of the substrate.

The primary approach used to address the delamination problem in convex cutter elements is the addition of transition layers made of materials with thermal and elastic properties located between the ultrahard material layer and the substrate, applied over the entire substrate protrusion surface. These transition layers have the effect of reducing the residual stresses at the interface and thus improving the resistance of the inserts to delamination.

Transition layers have significantly reduced the magnitude of detrimental residual stresses and correspondingly increased durability of inserts in application. Nevertheless, basic failure modes still remain. These failure modes involve complex combinations of three mechanisms, including wear of the PCD, surface initiated fatigue crack growth, and impact-initiated failure.

It is, therefore, desirable that an insert structure be constructed that provides desired PCD properties of hardness and wear resistance with improved properties of fracture toughness and chipping resistance, as compared to conventional PCD materials and insert structures, for use in aggressive cutting and/or drilling applications.

SUMMARY OF INVENTION

In one aspect, embodiments disclosed herein relate to an insert for a drill bit that includes a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains; and at least two transition layers between the metallic carbide body and the outer layer, the at least two transition layers comprising: an outermost transition layer comprising a composite of second diamond grains, first metal carbide or carbonitride particles, and a second binder material; and an innermost transition layer comprising a composite of third diamond grains, second metal carbide or carbonitride particles, and a third binder material wherein a thickness of the outer layer is lesser than that of each of the at least two transition layers.

In another aspect, embodiments disclosed herein relate to an insert for a drill bit that includes a metallic carbide body; an outer layer of polycrystalline diamond material on the outermost end of the insert, the polycrystalline diamond material comprising a plurality of interconnected first diamond grains and a first binder material and first metal carbide or carbonitride particles in interstitial regions between the interconnected first diamond grains; and at least one transition layer between the metallic carbide body and the outer layer, the at least one transition layer comprising a composite of second diamond grains, first metal carbide or carbonitride particles, and a second binder material, wherein a thickness of the outer layer is greater than a thickness of the at least one transition layer.

In yet another aspect, embodiments disclosed herein relate to an insert for a drill bit that includes a metallic carbide body; an outer layer of polycrystalline diamond material on the outermost end of the insert, the polycrystalline diamond material comprising a plurality of interconnected first diamond grains and a first binder material in interstitial regions between the interconnected first diamond grains, the plurality of first diamond grains occupying more than 91.5 volume percent of the outer layer; and at least one transition layers between the metallic carbide body and the outer layer, the at least one transition layers comprising a composite of second diamond grains, first metal carbide or carbonitride particles, and a second binder material; and wherein a thickness of the outer layer is lesser than that of the at least one transition layer.

Other aspects and advantages of the invention will be apparent from the following description and the appended claims.

DETAILED DESCRIPTION

In one aspect, embodiments disclosed herein relate to polycrystalline diamond enhanced inserts for use in drill bits, such as roller cone bits and hammer bits. More specifically, embodiments disclosed herein relate to polycrystalline diamond enhanced inserts having a polycrystalline diamond outer layer and at least one transition layer, where the relative thickness of the at least one transition layer is selected based on the composition of the polycrystalline diamond outer layer. Whereas a conventional approach to achieving a balance between hardness/wear resistance with impact resistance involves varying the formulation of materials (diamond, metal, carbides) used to form the polycrystalline diamond layer, embodiments of the present disclosure consider the entire insert structure, particularly the selection of the outer layer composition and thickness in combination with the thickness(es) of the at least one transition layer, to each both the desired wear and impact resistance properties. Specifically, for an insert having a relatively harder diamond outer layer, the transition layers may be relatively thicker than the diamond outer layer, whereas for an insert having a relatively tough diamond outer layer, the transition layer(s) may be relatively thinner than the diamond outer layer.

Figure 1A:
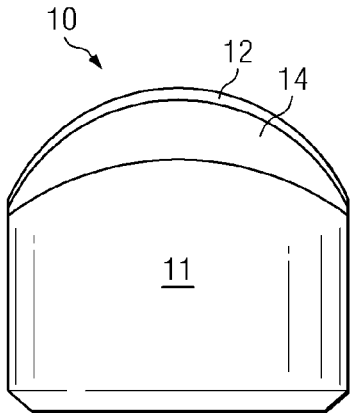
FIGS. 1A and 1B show embodiments of cutting elements of the present disclosure.

Referring to FIG. 1A, a cutting element in accordance with one embodiment of the present disclosure is shown. As shown in FIG. 1A, a cutting element 10 includes a polycrystalline diamond outer layer 12 that forms the working or exposed surface for contacting the earth formation or other substrate to be cut. Under the polycrystalline diamond outer layer 12, at least one transition layer 14 is disposed between the polycrystalline diamond outer layer 12 and the substrate 11. While a single transition layer is shown in FIG. 1A, some embodiments may only include two, three, even more transition layers. For example, in the embodiment shown in FIG. 1B, between polycrystalline diamond outer layer 12 and substrate 11, an outer transition layer 16 (located adjacent polycrystalline diamond outer layer 12) and an inner transition layer 18 (located adjacent substrate 11), collectively referred to as at least one transition layer 14, are disposed. Further, in embodiments having more than two transition layers, such additional layers located between the outer transition layer 16 and the inner transition layer 18 may be referred to as intermediate transition layers. In the embodiments shown in FIGS. 1A and 1B, the polycrystalline diamond outer layer 12 is thinner relative to the at least one transition layer 14.

Figure 2A:
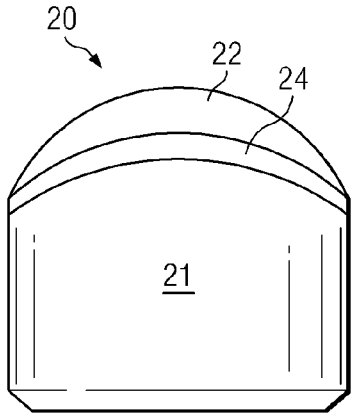
FIGS. 2A and 2B show embodiments of cutting elements of the present disclosure.

Referring to FIG. 2A, a cutting element in accordance with another embodiment of the present disclosure is shown. As shown in FIG. 2A, a cutting element 20 includes a polycrystalline diamond outer layer 22 that forms the working or exposed surface for contacting the earth formation or other substrate to be cut. Under the polycrystalline diamond outer layer 22, at least one transition layer 24 is disposed between the polycrystalline diamond outer layer 22 and the substrate 21. While a single transition layer is shown in FIG. 2A, some embodiments may only include two, three, even more transition layers. For example, in the embodiment shown in FIG. 2B, between polycrystalline diamond outer layer 22 and substrate 21, an outer transition layer 26 (located adjacent polycrystalline diamond outer layer 22) and an inner transition layer 28 (located adjacent substrate 21), collectively referred to as at least one transition layer 24, are disposed. Further, in embodiments having more than two transition layers, such additional layers located between the outer transition layer 26 and the inner transition layer 28 may be referred to as intermediate transition layers. In the embodiments shown in FIGS. 2A and 2B, the polycrystalline diamond outer layer 22 is thicker relative to the at least one transition layer 24.

The polycrystalline diamond outer layer discussed above may include a body of diamond particles bonded together to form a three-dimensional diamond network where a metallic phase may be present in the interstitial regions disposed between the diamond particles. In particular, as used herein, "polycrystalline diamond" or "a polycrystalline diamond material" refers to this three-dimensional network or lattice of bonded together diamond grains. Specifically, the diamond to diamond bonding is catalyzed by a metal (such as cobalt) by a high temperature/high pressure process, whereby the metal remains in the regions between the particles. Thus, the metal particles added to the diamond particles may function as a catalyst and/or binder, depending on the exposure to diamond particles that can be catalyzed as well as the temperature/pressure conditions. For the purposes of this application, when the metallic component is referred to as a metal binder, it does not necessarily mean that no catalyzing function is also being performed, and when the metallic component is referred to as a metal catalyst, it does not necessarily mean that no binding function is also being performed.

Depending on the relative abrasion resistance/toughness desired for the polycrystalline diamond outer layer, a quantity of diamond particles may be replaced with metal carbide particles added with the metal binder to create a tougher outer layer than the polycrystalline diamond layer without the metal carbide particles. Thus, for the embodiments shown in FIGS. 1A and 1B, the thinner outer layer may be desired for a more abrasion resistant polycrystalline diamond composition, which may include no or minimal amounts of metal carbide (less than 3 volume percent). Conversely, for the embodiments shown in FIGS. 2A and 2B, the thicker outer layer may be desired for a tougher polycrystalline diamond composition, which may include at least minimal amounts of metal carbide (at least 1 volume percent).

In embodiments that include a metal carbide in the outer layer, those embodiments may include between about 1 and 9 volume percent of a metal carbide, and between about 3 and 7 volume percent of a metal carbide in other embodiments. The use of metal carbide particles in the outer layer may be particularly desired when a tougher outer layer is desired, to be used in conjunction with thinner transition layers. However, metal carbide particles may be present in amounts less than about 3 volume percent, and preferably less than about 1 volume percent, in the more abrasive layers (used in conjunction with thicker transition layers).

Further, the presence of metal carbide may impact the diamond content of the outer layer. Thus, for example, for the embodiments shown in FIGS. 1A and 1B, the thinner outer layer formed of a more abrasion resistant polycrystalline diamond composition may have a diamond content of at least about 91.5 volume percent, and at least about 93 volume percent in particular embodiments. Such a diamond content may produce a layer having a very high hardness, such as a hardness value of greater than about 3500 HV. For the embodiments shown in FIGS. 2A and 2B, the thicker outer layer formed of a tougher polycrystalline diamond composition may have a diamond content of less than about 90.5 volume percent, and less than about 89 volume percent in particular embodiments. Such a diamond content may produce a layer having a lesser hardness, such as a hardness value of less than about 3500 HV, and less than about 3000 HV in other embodiments. However, the diamond content of the outer layer may ultimately be selected based on the desired material properties of the layer, and thus, it is not outside the scope of the present disclosure for other diamond contents to be envisaged for use in the cutting elements disclosed herein.

Further, as discussed above, in the embodiments shown in FIGS. 1A and 1B, the outer layer 12 is referred to as being "thinner." According to a particular embodiment, such "thinner" outer layer 12 may have a thickness of less than about 635 microns, less than about 400 microns in a more particular embodiment, and less than about 300 microns in an even more particular embodiment. Similarly, outer layer 22 is referred to in the embodiments shown in FIGS. 2A and 2B, as being "thicker." According to a particular embodiment, such "thicker" outer layer 22 may have a thickness of at least about 635 microns, and at least about 1000 microns in a more particular embodiment, and no more than 2000 microns in an even more particular embodiment.

As discussed above, the cutting elements of the present disclosure may have at least one transition layer. The at least one transition layer may include composites of diamond grains, a metal binder, and metal carbide or carbonitride particles. One skilled in the art should appreciate after learning the teachings of the present invention contained this application that the relative amounts of diamond and metal carbide or carbonitride particles may indicate the extent of diamond-to-diamond bonding within the layer.

The presence of at least one transition layer between the polycrystalline diamond outer layer and the insert body/substrate may create a gradient with respect to thermal expansion coefficients and elasticity, minimizing a sharp change in thermal expansion coefficient and elasticity between the layers that would otherwise contribute to cracking and chipping of the PCD layer from the insert body/substrate. Such a gradient may include a gradient in the diamond content between the outer layer and the transition layer(s), decreasing from the outer layer moving towards the insert body, coupled with a metal carbide content that increases from the outer layer moving towards the insert body.

Thus, the at least one transition layer may include composites of diamond grains, a metal binder, and carbide or carbonitride particles, such as carbide or carbonitride particles of tungsten, tantalum, titanium, chromium, molybdenum, vanadium, niobium, hafnium, zirconium, or mixtures thereof, which may include angular or spherical particles. When using tungsten carbide, it is within the scope of the present disclosure that such particles may include cemented tungsten carbide (WC/Co), stoichiometric tungsten carbide (WC), cast tungsten carbide ($WC/W_2C$), or a plasma sprayed alloy of tungsten carbide and cobalt (WC—Co). In a particular embodiment, either cemented tungsten carbide or stoichiometric tungsten carbide may be used, with size ranges of up to 6 microns for stoichiometric tungsten carbide or in the range of 5 to 30 microns (or up to the diamond grain size for the layer) for cemented particles. It is well known that various metal carbide or carbonitride compositions and binders may be used in addition to tungsten carbide and cobalt. Thus, references to the use of tungsten carbide and cobalt in the transition layers are for illustrative purposes only, and no limitation on the type of metal carbide/carbonitride or binder used in the transition layer is intended. Further, the same or similar carbide or carbonitride particle types may be present in the outer layer, when desired, as discussed above.

The carbide (or carbonitride) amount present in the at least one transition may vary between about 10 and 80 volume percent of the at least one transition layer. As discussed above, the use of transition layer(s) may allow for a gradient in the diamond and carbide content between the outer layer and the transition layer(s), the diamond decreasing from the outer layer moving towards the insert body, coupled with the metal carbide content increasing from the outer layer moving towards the insert body. Thus, depending on the number of transition layers used, the carbide content of a particular layer may be determined. For example, the outer transition layer may possess a carbide content of at least about 10 volume percent, while an intermediate layer may have a greater carbide content, such as at least about 20 volume percent. An innermost transition layer may have an even greater carbide content, such as at least about 30 volume percent. However, no limitation exists on the particular ranges. Rather, any range may be used in forming the carbide gradient between the layers. Further, if the carbide content is increasing between the outer layer and one or more transition layers, the diamond content may correspondingly decrease between the outer layer and the one or more transition layers. For example, the other transition layer may have a diamond content of no more than about 80 volume percent, the intermediate transition layer may have a diamond content of no more than about 60 volume percent, and the inner transition layer may have a diamond content of no more than about 40 volume percent.

In particular embodiments, however, the carbide content of each of the at least one transition layer may be selected based on the type of outer layer selected, the relative thicknesses of the outer layer and transition layer(s), as well as on the number of transition layers. For example, for a cutting element having a more abrasion resistant outer layer (and thicker transition layers) may have an outer transition layer having a carbide content of at least about 23 volume percent, an intermediate transition layer having a carbide content of at least about 40 volume percent, and an inner transition layer having a carbide content of at least about 55 volume percent. Thus, for such an embodiment, the outer transition layer may have a diamond content of no more than about 70 volume percent, an intermediate transition layer may have a diamond content of no more than about 53 volume percent, and an inner transition layer may have a diamond content of no more than about 35 volume percent. Such diamond content gradients may result in layers having a hardness value of less than 3100 HV (or less than 2800 HV), less than 2800 HV (or less than 2400 HV), and less than 2500 HV (or less than 2100 HV), respectively, for the outer transition layer, intermediate transition layer, and inner transition layer. Further, it is specifically within the scope of the present disclosure that other ranges may be used depending on the number of layers, the material properties of the outer layer, the desired properties of the multiple layers, etc.

Conversely, for a cutting element having a tougher outer layer (and thinner transition layers), the outer transition layer may have a carbide content of at least about 17 volume percent, the intermediate transition layer may have a carbide content of at least about 30 volume percent, and the inner transition layer may have a carbide content of at least about 45 volume percent. Thus, for such an embodiment, the outer transition layer may have a diamond content of no more than about 70 volume percent, an intermediate transition layer may have a diamond content of no more than about 50 volume percent, and an inner transition layer may have a diamond content of no more than about 35 volume percent. Such diamond content gradients may result in layers having a hardness value of less than 3100 HV, less than 2800 HV, and less than 2500 HV, respectively, for the outer transition layer, intermediate transition layer, and inner transition layer. Similarly, it is also specifically within the scope of the present disclosure that other ranges may be used depending on the number of layers, the material properties of the outer layer, the desired properties of the multiple layers, etc.

In comparing these two embodiments, the embodiment having the thinner, abrasion resistant outer layer has a comparatively greater amount of carbide in each of the transition layers, which may be desirable to balance the abrasion resistance (and less toughness) possessed in the outer layer, whereas in the other embodiment, the outer layer possess greater toughness.

Figure 3A:
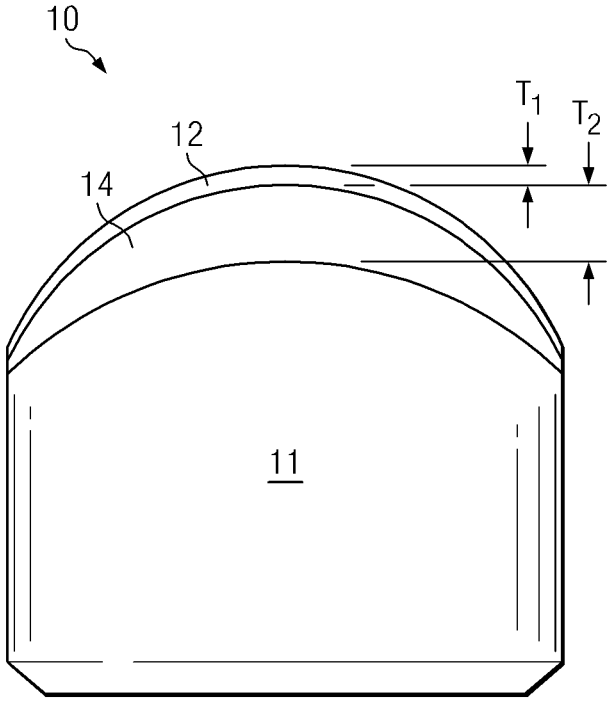
FIGS. 3A and 3B show embodiments of cutting elements of the present disclosure.
Figure 3B:
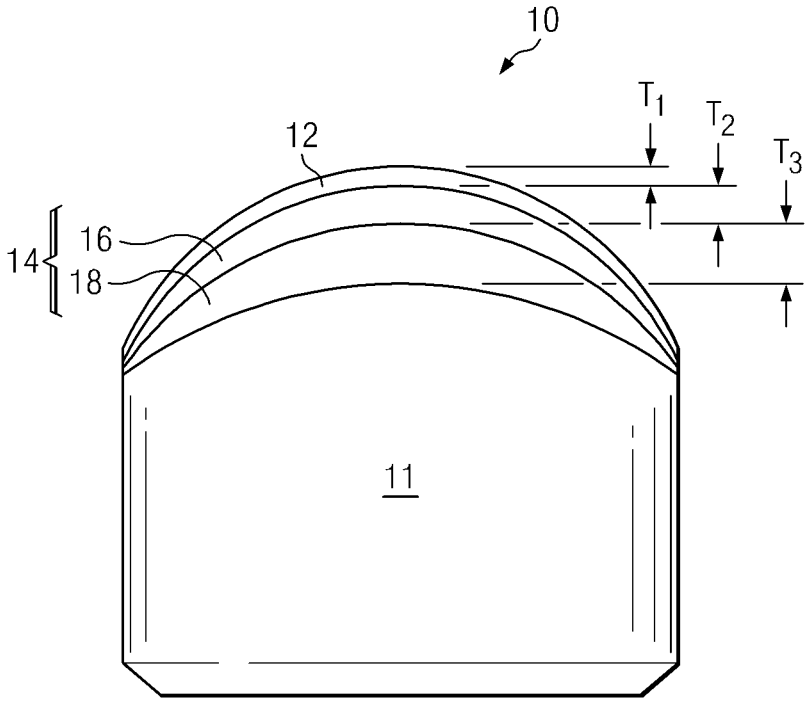

As discussed above, in accordance with the embodiments of the present disclosure there may be a thickness difference between the outer layer and the one or more transition layers. Referring to FIGS. 3A and 3B, an embodiment of a cutting element of the present disclosure is shown. As shown in FIG. 3A, a cutting element 10 includes a polycrystalline diamond outer layer 12, a transition layer 14, and a substrate 11, similar to the embodiment shown in FIG. 1A. However, as detailed in FIG. 3A, outer layer 12 has a thickness $T_1$ that is less than the thickness $T_2$ of transition layer 14. In particular embodiments, $T_2$ may be greater than $T_1$ by at least about 15% of $T_1$, or by at least about 25% of $T_i$ in other embodiments.

Figure 1B:
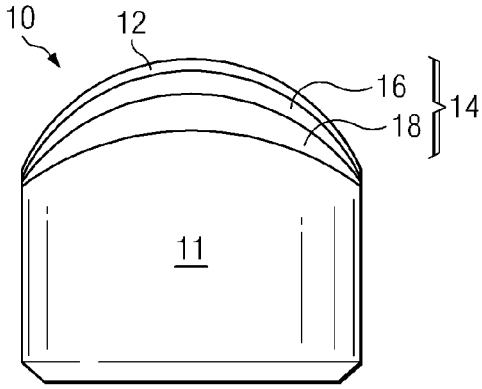

As shown in FIG. 3B, a cutting element 10 includes a polycrystalline diamond outer layer 12, at least one transition layer 14 (specifically, outer transition layer 16 and inner transition layer 18), and a substrate 11, similar to the embodiment shown in FIG. 1B. However, as detailed in FIG. 3B, outer layer 12 has a thickness $T_1$ that is less than the thickness $T_2$ of outer transition layer 16 and also less than the thickness $T_3$ of inner transition layer 18. $T_2$ and/or $T_3$ may each be greater than $T_1$ by at least about 15% of $T_i$ in some embodiments, or by at least about 25% of $T_1$ in other embodiments. Rewritten another way, $T_2$ and/or $T_3$ is at least $1.15*T_i$ in some embodiments and at least $1.25*T_i$ in other embodiments. In particular embodiments, the multiplying factor (e.g., 1.15, 1.25, etc.) may be selected by considering the number of layers. For example, in some embodiments, it may be desirable to determine the multiplying factor by adding (1+(1/number of total layers)). Further, it is also within the scope of the present disclosure that when using multiple transition layers, each transition layer may but need not have the same thickness. In the embodiment shown in FIG. 3B, for example, $T_1<T_2<T_3$. The total thickness of all layers may depend on the number of layers, the multiplying factor selected, as well as the material properties (and relative thickness) of the outer layer. For example, for a multiplying factor of at least 1.2*T1 and a first layer T1 of 250 micron, then T2 is 300 micron or greater and three layer structure would be 850 micron or greater and a four layer structure would be 1150 or greater. In another embodiment, for a multiplying factor of at least 2*T1 and T1 of 250 micron, then T2 is 500 micron, a three layer structure is 1250 micron or greater in thickness, and a four layer structure would then have a thickness greater than 1.75 mm.

Figure 4A:
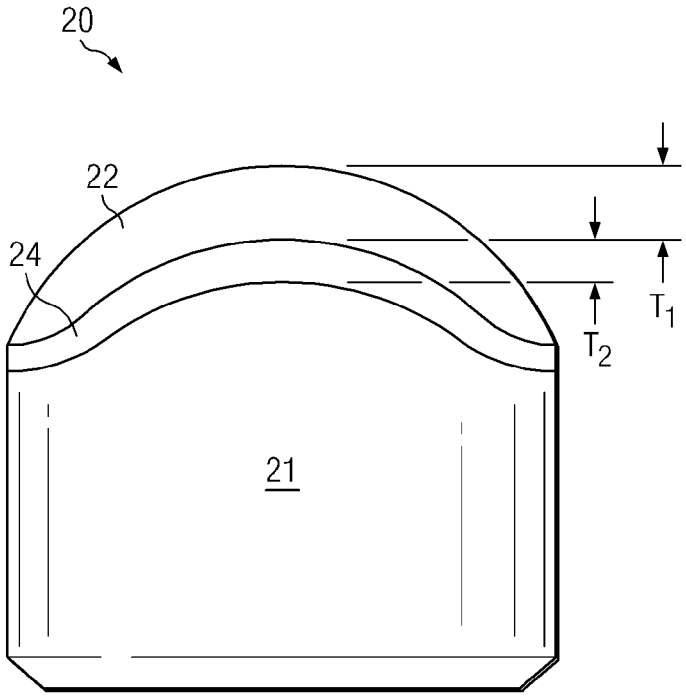
FIGS. 4A and 4B show embodiments of cutting elements of the present disclosure.
Figure 4B:
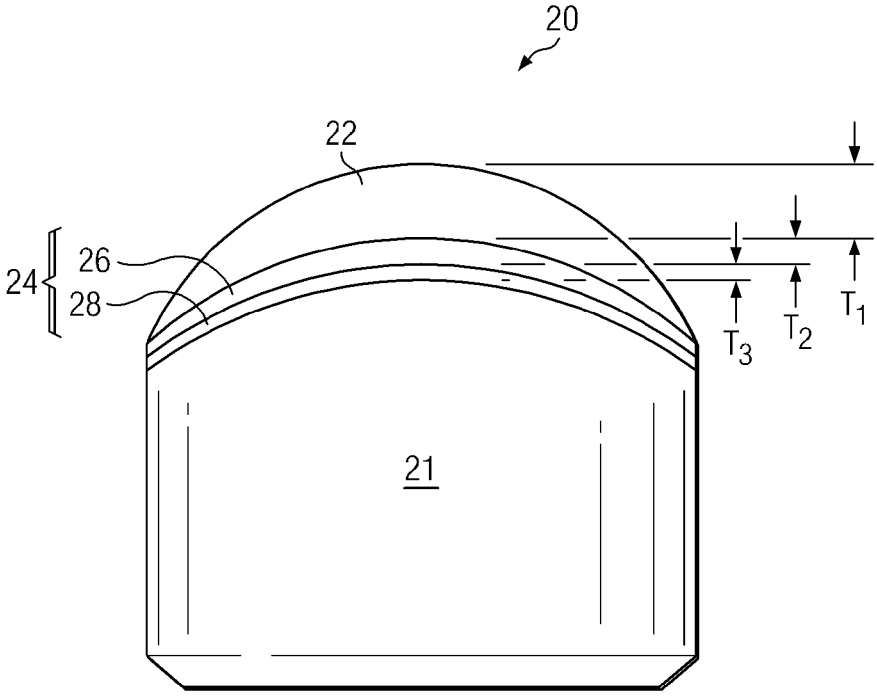

Referring to FIGS. 4A and 4B, another embodiment of a cutting element of the present disclosure is shown. As shown in FIG. 4A, a cutting element 20 includes a polycrystalline diamond outer layer 22, a transition layer 24, and a substrate 21, similar to the embodiment shown in FIG. 2A. However, as detailed in FIG. 4A, outer layer 22 has a thickness $T_1$ that is more than the thickness $T_2$ of transition layer 24. In particular embodiments, $T_2$ may be less than $T_1$ by at least about 15% of $T_1$, or by at least about 25% of $T_1$ in other embodiments.

Figure 2B:
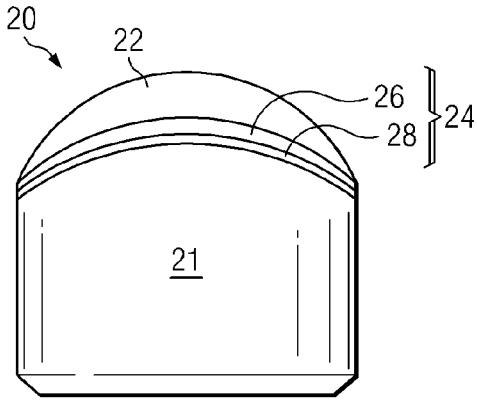

As shown in FIG. 4B, a cutting element 20 includes a polycrystalline diamond outer layer 22, at least one transition layer 24 (specifically, outer transition layer 26 and inner transition layer 28), and a substrate 21, similar to the embodiment shown in FIG. 2B. However, as detailed in FIG. 4B, outer layer 22 has a thickness $T_1$ that is more than the thickness $T_2$ of outer transition layer 26 and also more than the thickness $T_3$ of inner transition layer 28. $T_2$ and/or $T_3$ may each be less than $T_1$ by at least about 15% of $T_1$ in some embodiments, or by at least about 25% of $T_1$ in other embodiments. Rewritten another way, $T_2$ and/or $T_3$ is no more than $0.85*T_i$ in some embodiments and no more than $0.75*T_1$ in other embodiments. In particular embodiments, the multiplying factor (e.g., 0.75, 0.85, etc.) may be selected by considering the number of layers. For example, in some embodiments, it may be desirable to determine the multiplying factor by adding (1−(1/number of total layers)). Further, it is also within the scope of the present disclosure that when using multiple transition layers, each transition layer may but need not have the same thickness. In the embodiment shown in FIG. 4B, for example, $T_1>T_2>T_3$. As described above, the total thickness of all layers may depend on the number of layers, the multiplying factor selected, as well as the material properties (and relative thickness) of the outer layer. For example, for a multiplying factor of no more than 0.8*T1 and a first layer T1 of 1000 micron, then T2 is 800 micron or less and three layer structure would be 2.6 mm or less and a four layer structure would be 3.4 mm or less. In another embodiment, where the multiplying factor is no more than 0.2*T1 and the first layer T1 is 1000 microns, then T2 is 200 micron or less and three layer structure would be 1.4 mm or less and a four layer structure would be 1.6 mm or less.

Figure 5A:
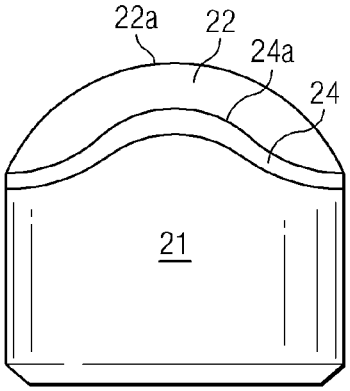
FIGS. 5A and 5B show embodiments of cutting elements of the present disclosure.
Figure 5B:
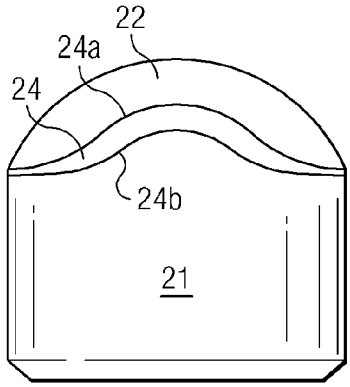

Further, comparing FIGS. 4A and 4B, it is also apparent the at least one transition layer 24 may optionally be provided with a contour or curvature differing that of the polycrystalline diamond outer layer 22. For example, as shown in FIG. 5A, the upper surface 24*a* of transition layer 24 is bell-shaped, containing both convex and concave portions, whereas the upper surface 22*a* of polycrystalline diamond outer layer 22 is dome-shaped, being only convex. Such difference in contours may allow for the polycrystalline diamond outer to have a variable thickness, and a greatest thickness in the critical or contact zone of the cutting element, such as described in U.S. Pat. No. 6,199,645, which is assigned to the present assignee and herein incorporated by reference in its entirety. The thickness of the transition layer 24 may be substantially the same throughout the entire layer, as shown in FIG. 5A, or, as shown in FIG. 5B, the thickness of transition layer 24 may taper approaching the periphery of the cutting element. Thus, in the embodiment shown in FIG. 5B, the upper surface 24*a* of the transition layer 24 has a contour or curvature differing that of its lower surface 24*b* (or the upper surface of the substrate 21 or optional second transition layer therebelow). The change in contour may be achieved through the use of one or more spreaders and/or use of carbide to spread the transition layer materials during the assembly of the cutting structure.

As discussed above, the outer layer and one or more transition layers both include a metal binder. The metal binder may be present in layer in an amount that is at least about 3 volume percent, and between 3 and 20 volume percent in other particular embodiments. One skilled in the art should appreciate after learning the teachings of the present invention contained this application the amount of binder used may depend on the location of the layer in addition to the material properties desired.

The insert body or substrate may be formed from a suitable material such as tungsten carbide, tantalum carbide, or titanium carbide. In the substrate, metal carbide grains are supported by a matrix of a metal binder. Thus, various binding metals may be present in the substrate, such as cobalt, nickel, iron, alloys thereof, or mixtures, thereof. In a particular embodiment, the insert body or substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes only, and no limitation on the type of carbide or binder use is intended.

As used herein, a polycrystalline diamond layer refers to a structure that includes diamond particles held together by intergranular diamond bonds, formed by placing an unsintered mass of diamond crystalline particles within a metal enclosure of a reaction cell of a HPHT apparatus and subjecting individual diamond crystals to sufficiently high pressure and high temperatures (sintering under HPHT conditions) that intercyrstalline bonding occurs between adjacent diamond crystals. A metal catalyst, such as cobalt or other Group VIII metals, may be included with the unsintered mass of crystalline particles to promote intercrystalline diamond-to-diamond bonding. The catalyst material may be provided in the form of powder and mixed with the diamond grains, or may be infiltrated into the diamond grains during HPHT sintering.

The reaction cell is then placed under processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD.

The transition layers may similarly be formed by placing an unsintered mass of the composite material containing diamond particles, tungsten carbide and cobalt within the HPHT apparatus. The reaction cell is then placed under processing conditions sufficient to cause sintering of the material to create the transition layer. Additionally, a preformed metal carbide substrate may be included. In which case, the processing conditions can join the sintered crystalline particles to the metal carbide substrate. Similarly, a substrate having one or more transition layers attached thereto may be used in the process to add another transition layer or a polycrystalline diamond layer. A suitable HPHT apparatus for this process is described in U.S. Pat. Nos. 2,947,611; 2,941,241; 2,941,248; 3,609,818; 3,767,371; 4,289,503; 4,673,414; and 4,954,139.

An exemplary minimum temperature is about 1200° C., and an exemplary minimum pressure is about 35 kilobars. Typical processing is at a pressure of about 45-55 kilobars and a temperature of about 1300-1400° C. The minimum sufficient temperature and pressure in a given embodiment may depend on other parameters such as the presence of a catalytic material, such as cobalt. Typically, the diamond crystals will be subjected to the HPHT sintering the presence of a diamond catalyst material, such as cobalt, to form an integral, tough, high strength mass or lattice. The catalyst, e.g., cobalt, may be used to promote recrystallization of the diamond particles and formation of the lattice structure, and thus, cobalt particles are typically found within the interstitial spaces in the diamond lattice structure. Those of ordinary skill will appreciate that a variety of temperatures and pressures may be used, and the scope of the present disclosure is not limited to specifically referenced temperatures and pressures.

Application of the HPHT processing will cause diamond crystals to sinter and form a polycrystalline diamond layer. Similarly, application of HPHT to the composite material will cause the diamond crystals and carbide particles to sinter such that they are no longer in the form of discrete particles that can be separated from each other. Further, all of the layers bond to each other and to the substrate during the HPHT process.

The average diamond grain size used to form the polycrystalline diamond outer layer may broadly range from about 2 to 30 microns in one embodiment, less than about 20 microns in another embodiment, and less than about 15 microns in yet another embodiment. Further, the diamond grain size of the at least one transition layer may broadly range from 2 to 50 microns. However, selection of the grain size may be dependent on the desired properties of the layer. For example, in particular embodiments, the average diamond grain size of the outer layer may range from about 2 to 8 microns, from about 4 to 8 microns, from about 10 to 12 microns, or from about 10 to 20 microns. However, it is also contemplated that other particular narrow ranges may be selected within the broad range, depending on the particular application and desired properties of the outer layer or at least one transition layer. Further, it is also within the present disclosure that the particles need not be unimodal, but may instead be bi- or otherwise multi-modal. Additionally, it is also within the scope of the present disclosure that the diamond grain size may be kept substantially the same between the outer layer and may exist as a size gradient between the outer layer and the at least one transition layer(s), as discussed in U.S. Patent Application 61/232,125, entitled "Highly Wear Resistant Diamond Insert with Improved Transition Structure", filed concurrently herewith, U.S. patent application Ser. No. 12/851,874 assigned to the present assignee and herein incorporated by reference in its entirety.

It is also within the scope of the present disclosure that the polycrystalline diamond outer layer may have at least a portion of the metal catalyst removed therefrom, such as by leaching the diamond layer with a leaching agent (often a strong acid). In a particular embodiment, at least a portion of the diamond layer may be leached in order to gain thermal stability without losing impact resistance.

Further, it is also within the scope of the present disclosure that the cuttings elements may include a single transition layer, with a gradient in the diamond/carbide content within the single transition layer. The gradient within the single transition layer may be generated by methods known in the art, including those described in U.S. Pat. No. 4,694,918, which is herein incorporated by reference in its entirety.

EXEMPLARY EMBODIMENTS

The following examples are provided in table form to aid in demonstrating the variations that may exist in the insert layer structure in accordance with the teachings of the present disclosure. Additionally, while each example is indicated to an outer layer with three transition layers, it is also within the present disclosure that more or less transition layers may be included between the outer layer and the carbide insert body (substrate). These examples are not intended to be limiting, but rather one skilled in the art should appreciate that further insert layer structure variations may exist within the scope of the present disclosure.

Example 1

| | Layers | | | |
|---|---|---|---|---|
| | Outer PCD | Outer Transition | Intermediate | Inner Transition |
| Thickness (micrometers) | >635 ($T_1$) | <0.85 * T1 | <0.85 * T1 | <0.85 * T1 |
| Hardness (HV) | <3500 | <3100 | <2800 | <2500 |
| Diamond % vol | <90.5 | <80 | <60 | <40 |
| WC % vol | 1-9 | >10 | >20 | >30 |

Example 2

| | Layers | | | |
|---|---|---|---|---|
| | Outer PCD | Outer Transition | Intermediate | Inner Transition |
| Thickness (micrometers) | >1000 ($T_1$) | <0.75 * T1 | <0.75 * T1 | <0.75 * T1 |
| Hardness (HV) | <3000 | <2800 | <2400 | <2100 |
| Diamond % vol | <89 | <70 | <50 | <35 |
| WC % vol | 3-7 | >17 | >30 | >45 |

Example 3

| | Layers | | | |
|---|---|---|---|---|
| | Outer PCD | Outer Transition | Intermediate | Inner Transition |
| Thickness (micrometers) | <635 | >1.15 * T1 | >1.15 * T1 | >1.15 * T1 |
| Hardness (HV) | >3500 | <3100 | <2800 | <2500 |
| Diamond % vol | >91.5 | <80 | <60 | <40 |
| WC % vol | <3 | >10 | >20 | >30 |

Example 4

| | Layers | | | |
|---|---|---|---|---|
| | Outer PCD | Outer Transition | Intermediate | Inner Transition |
| Thickness (micrometers) | <400 | >1.25 * T1 | >1.25 * T1 | >1.25 * T1 |
| Hardness (HV) | >3500 | <3100 | <2800 | <2500 |
| Diamond % vol | >93 | <70 | <53 | <35 |
| WC % vol | <1 | >23 | >40 | >55 |

It is desired that such cutting elements be adapted for use in such applications as cutting tools, roller cone bits, percussion or hammer bits, drag bits and other mining, construction and machine applications, where balanced abrasion resistance, impact resistance, toughness, and stiffness is desired.

Figure 6:
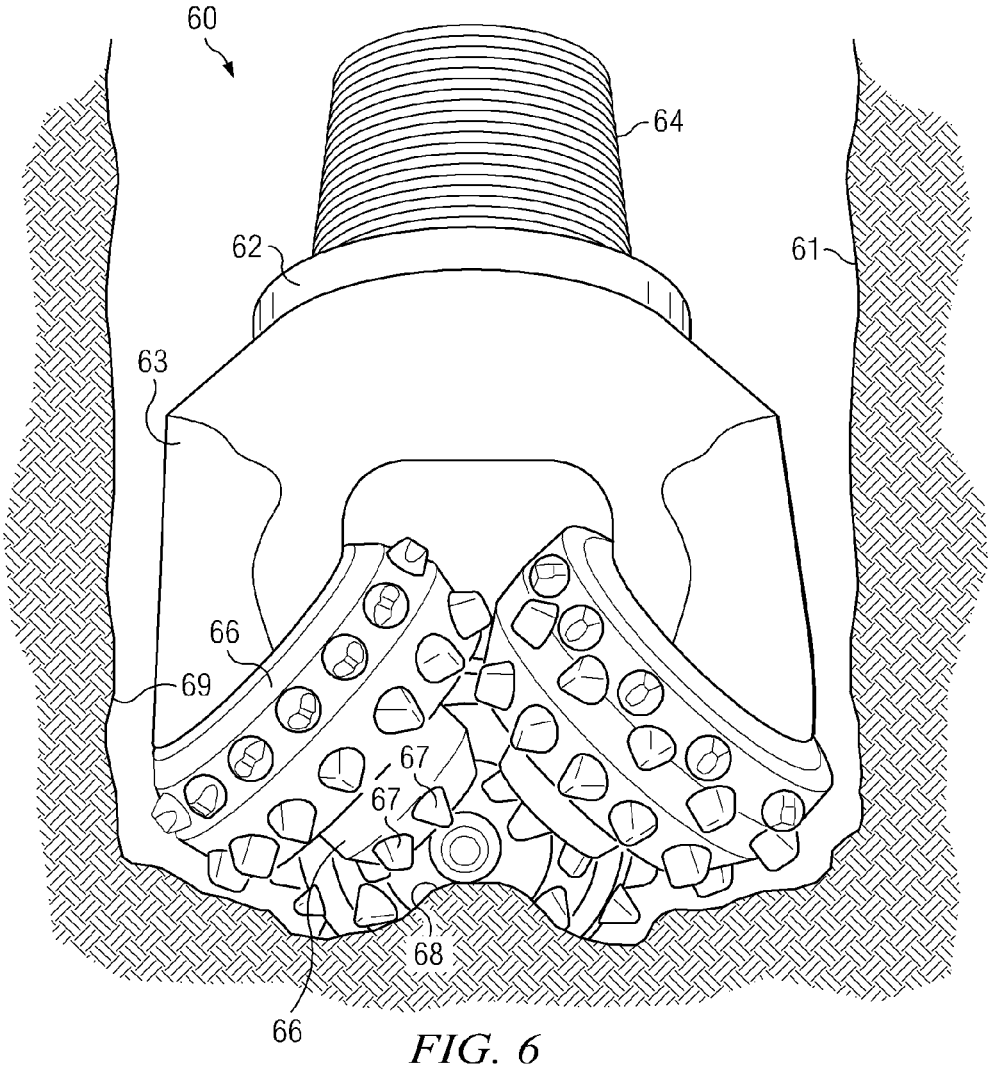
FIG. 6 shows a roller cone drill bit using a cutting element of the present disclosure.

The cutting elements of the present disclosure may find particular use in roller cone bits and hammer bits. Roller cone rock bits include a bit body adapted to be coupled to a rotatable drill string and include at least one "cone" that is rotatably mounted to the bit body. Referring to FIG. 6, a roller cone rock bit 60 is shown disposed in a borehole 61. The bit 60 has a body 62 with legs 63 extending generally downward, and a threaded pin end 64 opposite thereto for attachment to a drill string (not shown). Journal shafts (not shown) are cantilevered from legs 63. Roller cones (or rolling cutters) 66 are rotatably mounted on journal shafts. Each roller cone 66 has a plurality of cutting elements 67 mounted thereon. As the body 60 is rotated by rotation of the drill string (not shown), the roller cones 66 rotate over the borehole bottom 68 and maintain the gage of the borehole by rotating against a portion of the borehole sidewall 69. As the roller cone 66 rotates, individual cutting elements 67 are rotated into contact with the formation and then out of contact with the formation.

Figure 7:
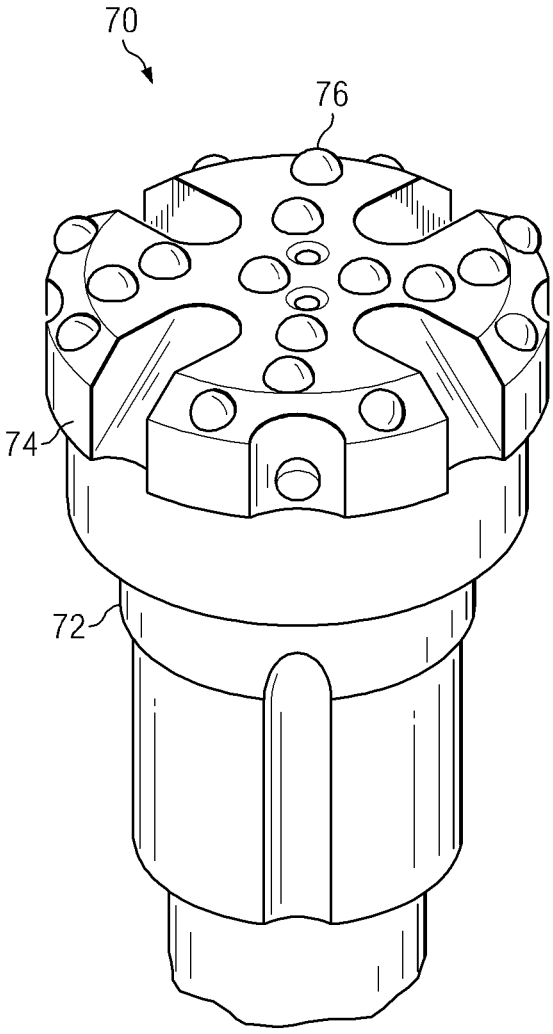
FIG. 7 shows a hammer bit using a cutting element of the present disclosure.

Hammer bits typically are impacted by a percussion hammer while being rotated against the earth formation being drilled. Referring to FIG. 7, a hammer bit is shown. The hammer bit 70 has a body 72 with a head 74 at one end thereof. The body 72 is received in a hammer (not shown), and the hammer moves the head 74 against the formation to fracture the formation. Cutting elements 76 are mounted in the head 74. Typically the cutting elements 76 are embedded in the drill bit by press fitting or brazing into the bit.

The cutting inserts of the present disclosure may have a body having a cylindrical grip portion from which a convex protrusion extends. The grip is embedded in and affixed to the roller cone or hammer bit, and the protrusion extends outwardly from the surface of the roller cone or hammer bit. The protrusion, for example, may be hemispherical, which is commonly referred to as a semi-round top (SRT), or may be conical, or chisel-shaped, or may form a ridge that is inclined relative to the plane of intersection between the grip and the protrusion. In some embodiments, the polycrystalline diamond outer layer and one or more transition layers may extend beyond the convex protrusion and may coat the cylindrical grip. Additionally, it is also within the scope of the present disclosure that the cutting elements described herein may have a planar upper surface, such as would be used in a drag bit.

Embodiments of the present disclosure may provide at least one of the following advantages. In a typical drilling application, the outer diamond layer is subjected to impact cyclic loading. It is also typical for the diamond material to have multiple cracks that extend downward and inward. However, use of the layers of the present disclosure use a gradient in diamond grain size to result an insert structure that maintains the wear resistance of the outer layer while significantly boosting the toughness and stiffness of the entire insert through the transition layer(s). Specifically, the combination of such a thin, abrasion resistant outer layer with tough, thicker transition layers results in a total insert structure that improves the stiffness and toughness of the diamond insert while maintaining abrasion resistance. Additionally, the resistance of the diamond cutting element to impact and breakage may be improved by increasing the thickness of the diamond outer layer material that has relatively low wear resistance and relatively high toughness, coupled with the use of thinner transition layers to minimize the accumulation of unnecessary residual stresses While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. An insert for a drill bit comprising:

a metallic carbide body;

an outer layer of polycrystalline diamond material on the outermost end of the insert, the polycrystalline diamond material comprising a plurality of interconnected first diamond grains and a first binder material and first metal carbide or carbonitride particles in interstitial regions between the interconnected first diamond grains; and at least one transition layer between the metallic, carbide body and the outer layer, the at least one transition layer comprising a composite of second diamond grains, first metal carbide or carbonitride particles, and a second binder material, wherein each of the at least one transition layers has a central thickness of about 85% or less than a central thickness of the outer layer.

2. The insert of claim 1, wherein the outer layer has a central thickness of greater than about 635 microns.

3. The insert of claim 2, wherein the outer layer has a central thickness of greater than about 1000 microns.

4. The insert of claim 1, wherein each of the at least one transition layers has a central thickness of about 75% or less than the central thickness of the outer layer.

5. The insert of claim 1, wherein the outer layer has a diamond content of no more than about 90.5 volume percent.

6. The insert of claim 5, wherein the outer layer has a diamond content of no more than about 89 volume percent.

7. The insert of claim 1, wherein the at least one transition layer has a diamond content of less than about 80 volume percent.

8. The insert of claim 1 wherein the outer layer has a metal carbide or carboninide content between about 1 and 9 volume percent.

9. The insert of claim 8, wherein the outer layer has a metal carbide or carbonitride content between about 3 and 7 volume percent.

10. The insert of claim 1, wherein the outer layer has a hardness value of less than about 3500 HV.

11. The insert of claim 1, wherein the at least one transition layer has a hardness value of less than about 3100 HV.

12. The insert of claim 1, wherein at least one of said outer layer and said at least two transition layers has a thickness that decreases from a central portion towards a peripheral portion of said at least one layer.

* * * * *